US005911533A

United States Patent [19]

Fassler et al.

[11] Patent Number: 5,911,533

[45] Date of Patent: Jun. 15, 1999

[54] MICROFLUIDIC WRITING PEN

[75] Inventors: Werner Fassler, Rochester; James E. Pickering, Bloomfield; Kin K. Lum, Webster, all of N.Y.

[73] Assignee: Eastman Kodak Company, Rochester, N.Y.

[21] Appl. No.: 08/977,216

[22] Filed: Nov. 24, 1997

[51] Int. Cl.[6] ..... B43K 5/12

[52] U.S. Cl. ..... 401/195; 401/44; 401/45

[58] Field of Search ..... 401/195, 44, 45, 401/46, 47

[56] References Cited

U.S. PATENT DOCUMENTS 5,306,092 4/1994 Jenq ..... 401/47
5,383,736 1/1995 Okulov ..... 401/47

FOREIGN PATENT DOCUMENTS 839076 12/1957 United Kingdom ..... 401/44

*Primary Examiner*—David J. Walczak
*Attorney, Agent, or Firm*—Raymond L. Owens

[57] ABSTRACT

A microfluidic pen for selectivly writing lines of different colors, includes a colorant mixing chamber and a writing tip in communication with the colorant mixing chamber; a plurality of colorant reservoirs disposed in the pen and which contain different colorants; microkinetic pump selectively effective to deliver colorant in selected amounts from the colorant reservoirs to the colorant mixing chamber wherein the colorants are mixed to provide a colorant of the desired color. The color is selected by a user and actuates the microkinetic pump to cause the desired amount of colorants to be delivered to the colorant mixing chamber where the writing tip can write a line of the desired line colors.

4 Claims, 3 Drawing Sheets

MICROFLUIDIC WRITING PEN

CROSS REFERENCE TO RELATED APPLICATIONS

Reference is made to commonly assigned U.S. pat. application Ser. No. 08/868,426, filed Jun. 3,1997 entitled "Continuous Tone Microfluidic Printing", by DeBoer, Fassler, and Wen. The disclosure of this related application is incorporated herein by reference.

FIELD OF THE INVENTION

The present invention relates to a personal writting instrument and, more particularly, to a microfluidic pen.

BACKGROUND OF THE INVENTION

Microfluidic pumping and dispensing of liquid chemical reagents is the subject of three U.S. Pat. Nos. 5,585,069, 5,593,838, and 5,603,351, all assigned to the David Sarnoff Research Center, Inc. The system uses an array of micron sized reservoirs, with connecting micro channels and reaction cells etched into a substrate. Electrokinetic pumps comprising electrically activated electrodes within the capillary micro channels provide the propulsive forces to move the liquid reagents within the system. The electrokinetic pump, which is also known as an electroosmotic pump, has been disclosed by Dasgupta et al., see Electroosmosis: A Reliable Fluid Propulsion System for Flow Injection Analysis, Anal. Chem. 66, pp 1792–1798 (1994). The chemical reagent solutions are pumped from a reservoir, mixed in controlled amounts, and then pumped into a bottom array of reaction cells. The array may be decoupled from the assembly and removed for incubation or analysis.

Writing devices have their own sets of problems. One problem is to provide a writing pen which can selectively provide different colors. It is difficult with such writing instruments to provide continuous tone colors with a wide range of hue variations.

SUMMARY OF THE INVENTION

It is an object of this invention is to provide a pen to write all different color hues on a suitable receiver.

It is a further object of the invention to provide a compact, low powered pen which could rapidly write a high quality line on paper at any pre-set color.

Another object of this invention is to provide a compact, low power, portable pen to write lines which can have various thicknesses.

These objects are achieved by a microfluidic pen for selectively writing lines of different colors, comprising:

a) means defining an ink mixing chamber and a writing tip in communication with the ink mixing chamber;

b) a plurality of colorant reservoirs disposed in the pen and which contain different colorants;

c) pumping means selectively effective to deliver colorant in selected amounts from the colorant reservoirs to the ink mixing chamber wherein the colorants are mixed to provide a colorant of the desired color;

d) color selector means responsive to a user selecting the desired line colors and for actuating the pumping means so as to cause the desired amount of colorants to be delivered to the ink mixing chamber where the writing tip can write a line of the desired line colors.

ADVANTAGES

The present invention provides high quality lines of desired line width, density, and color hue on a writing surface.

Another feature of the invention is that the pen is low power, compact refillable and portable.

DETAILED DESCRIPTION OF THE INVENTION

Figure 1:
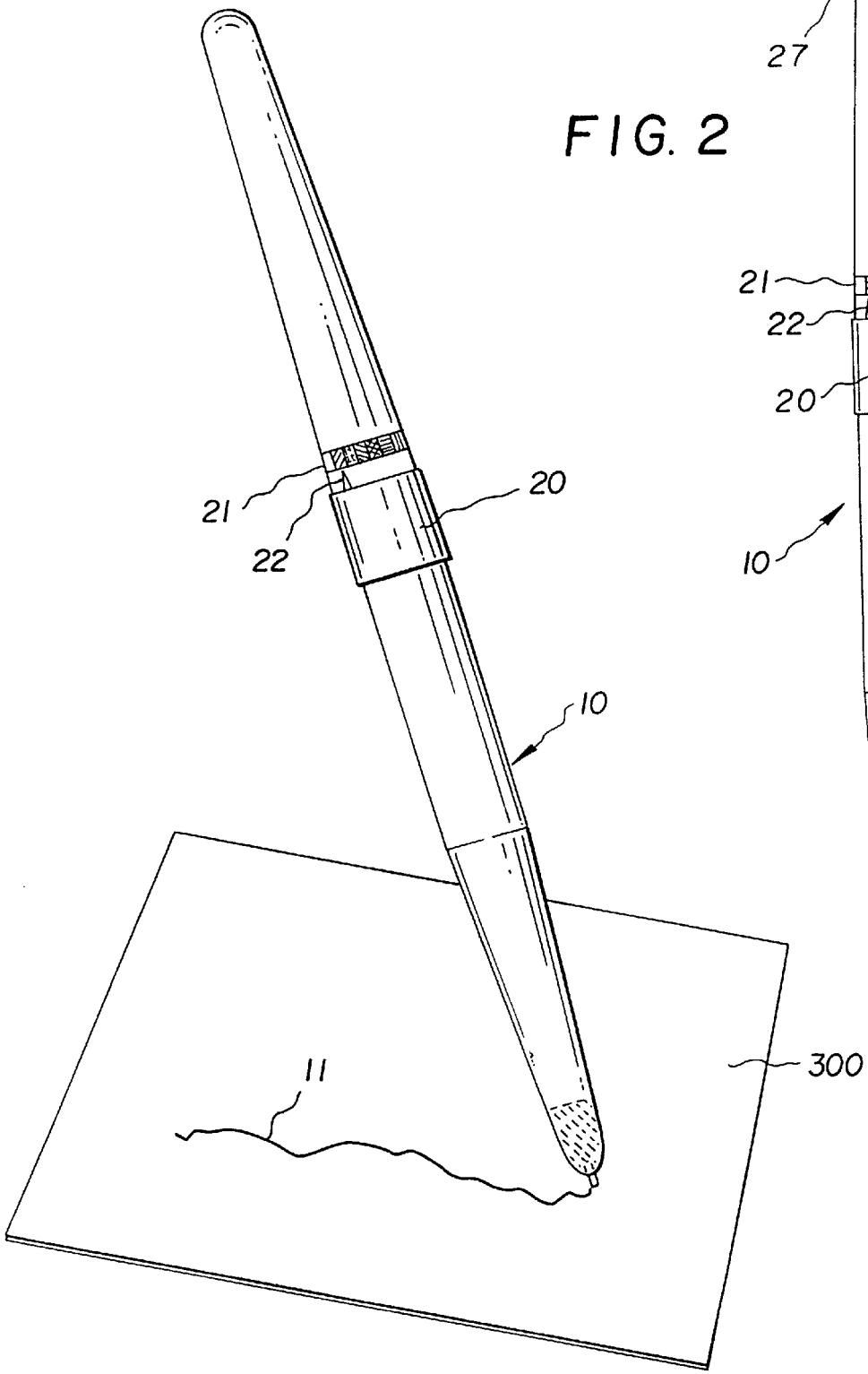
FIG. 1 is a perspective showing a writing pen with a color hue adjustment knob.

Colorants in accordance with the present invention can be dispersions of cyan, magenta, and yellow colorants. Preferably as will be described a single mixing chamber is used to mix the colorants to obtain the hue as selected by the user of the pen. When contacted with paper, the capillary force of the paper fibers pulls the colorant from the cells and holds it in the paper, thus producing a line on. The present invention provides accurate control of the colorant density and ensures that the capillary force of the paper fibers is strong enough to pull the colorant from the pen at a permitable capillary flow and a microfluidic pump controls the mixture and impacts the capillary flow rate.

The colorants used in this invention can be those commonly used in ink jet printers. Examples of water soluable dyes are CI direct Yellow 132, C1 Acid Yellow 23, C1 acid red 52, C1 acid red 249, CL direct blue 9, C1 food black 2, and C1 direct black 168. Inks made up with dispersion of colorants in water or other common solvents can also be used in this invention. Examples of such inks may be found in U.S. Pat. No. 5,611,847 by Gustina, Santilli, and Burgner; U.S. patent application Ser. No. 08/699,955 and U.S. patent application Ser. No. 08/699,963, both filed Aug. 20, 1996 by McInerney, Olfield,Bugner, Bermel, and Santilli; U.S. patent application Ser. No. 08/790,131 filed Jan. 29, 1997 by Bishop, Simons and Brick; and in U.S. patent application Ser. No. 08/764,379 filed Dec. 13, 1996 by Martin.

Figure 2:
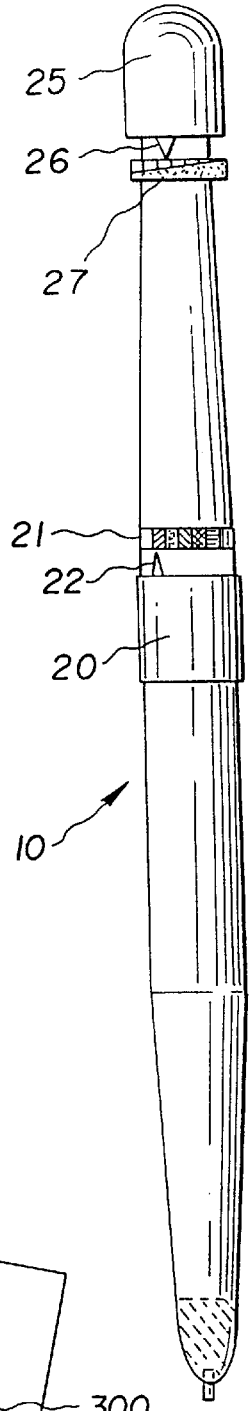
FIG. 2 is a view showing another embodiment of a writing pen which can adjust color, line thickness, and select the desired colorant.
Figure 3:
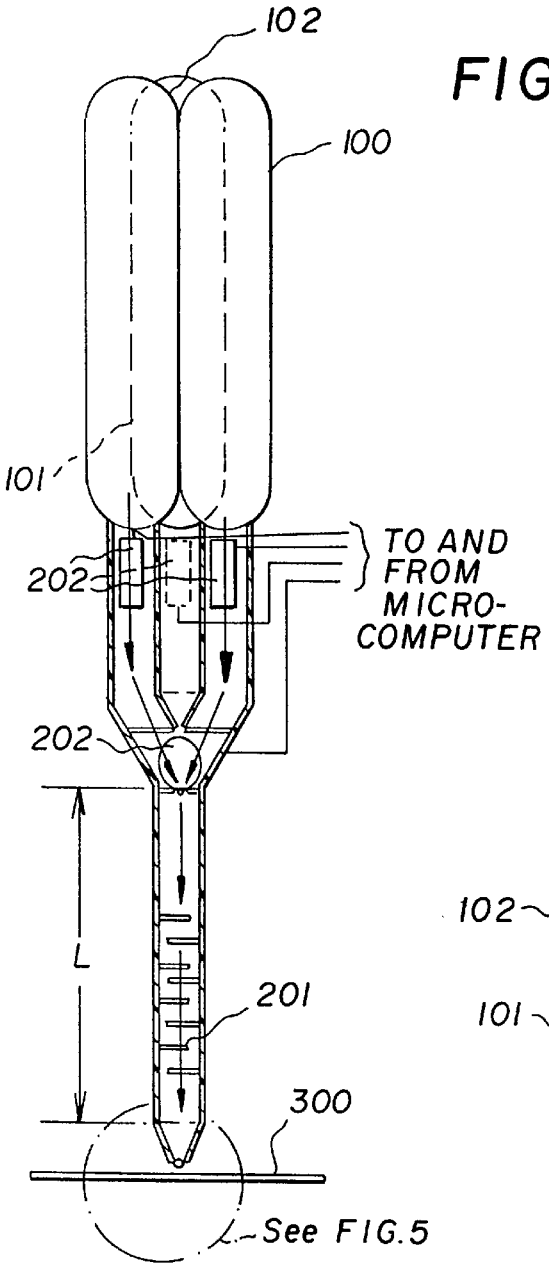
FIG. 3 is a sectional view showing internal parts of the microfludic pen of FIGS. 1 and 2.

Referring now to FIGS. 1–3, the pen 10 includes three supply reservoirs 100, 101, and 102 (FIGS. 3 and 4) for the colorants and micro-channels 200 to conduct the colorants from the supply reservoirs 100, 101, 102 into a mixing chamber 201 and onto a receiver surface 300. The mixing chamber 201 mixes the colorants before delivery to the receiver surface 300. FIG. 1 shows the pen 10 and a line 11 being written by the pen 10 on the receiver surface 300. The casing of the pen 10 in FIG. 1 includes a rotatable color selection knob 20 and a color selection chart 21. The selected color is indicated by a pointer 22 fixed to the rotatable knob 20. The casing of FIG. 2 includes the same structure as that of FIG. 1 and it also has a rotating line width adjusting knob 25 which includes pointer 26. The line width chart 27 is also provided.

FIG. 3 shows the mixing chamber 201 and three microkinetic electrodes 202 each associated with a different color supply reservoir 100, 101 and 102 respectively. Each pump is disposed in one micro-channels 200 and includes an electrode and one common electrode located in the mixing chamber 201. As will be discussed, these microkinetic electrodes 202 cause the delivery of colorants to the mixing chamber 201 wherein the colorants are mixed so that a line of any color can be written.

Each pair of electrodes associated with each color supply reservoir 100, 101, 102 constitutes the microkinetic electrode 202 of this invention. As will be described more fully with reference to FIG. 6, application of a potential between the electrodes of each microkinetic electrode 202 causes the flow of colorant into the corresponding micro-channels 200 and into the colorant mixing chamber 201. When the colorant mixing chamber 201 has received the correct amount of each colorant to reproduce the selected color of the line to be written, the correct color is mixed in the mixing chamber 201 before the line is written on a receiver 300. If a single line with a preferred or special colorant is written, another color supply reservoir (not shown), with a microkinetic pump can be provided for writing a single color. That colorant can, of course, be black or blue.

The pen tip writes by contacting a suitable reciever surface and this contact pressure is sensed so that circuitry activates the microkinetic pumps to supply the colorant in the selected measure. The pressure sensor can be a simple switch or a pressure drop in the mixing chamber can be sensed to register the mode of writing in the microcomputer 500.

Figure 5:
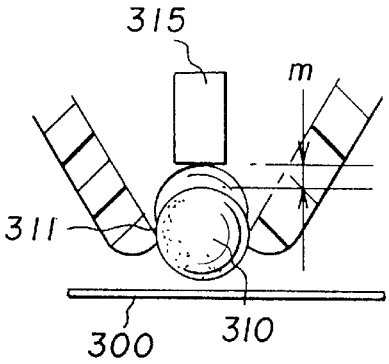
FIG. 5 is a detail of the tip of the pen of FIG. 4.
Figure 4:
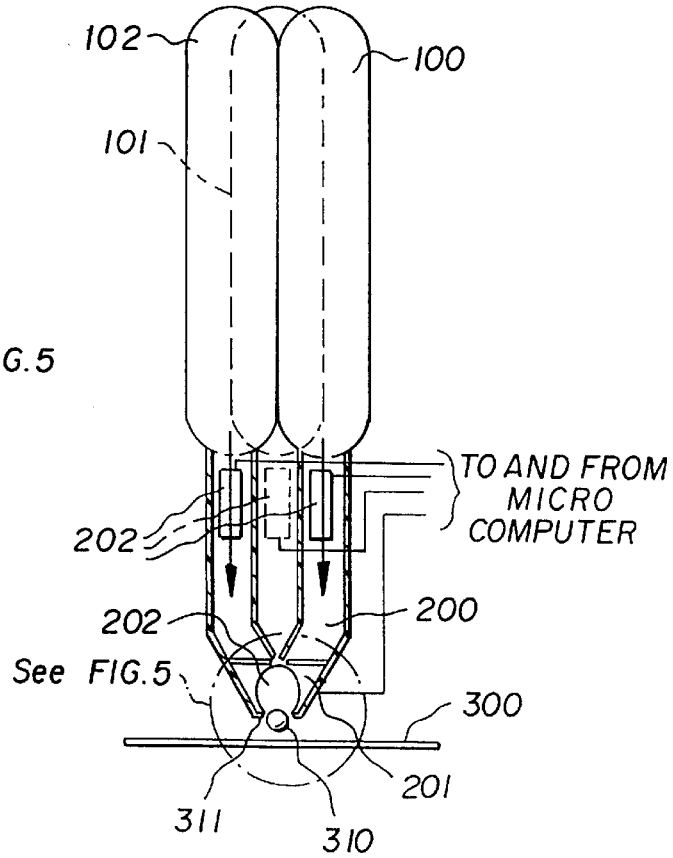
FIG. 4 shows another embodiment of the invention with a smaller mixing chamber than in FIG. 3.

Turning now to FIGS. 4 and 5, where there is shown a shorter mixing chamber 201 than the pen 10 of FIG. 3. Further, a tip 310 is in the form of a rotating ball. When a user presses the tip 310 against the receiver 300 it causes the ball to open a channel 311 which couples the mixing chamber 201 to the receiver surface. The tip moves up a distance m. A microswitch 315 is actuated by the tip 310 moving upwardly which causes a signal to be sent to a micro-computer 500 shown in FIG. 6. When the tip 310 is removed from the receiver 300, it closes off the channel 311 to prevent the flow of mixed colorant from the mixing chamber 201 to the receiver 300 surface. It should be noted that the arrows in FIGS. 3 and 4 show the flow of colorant from the color supply reservoirs 100, 101, 102 to the receiver 300 surface.

Figure 6:
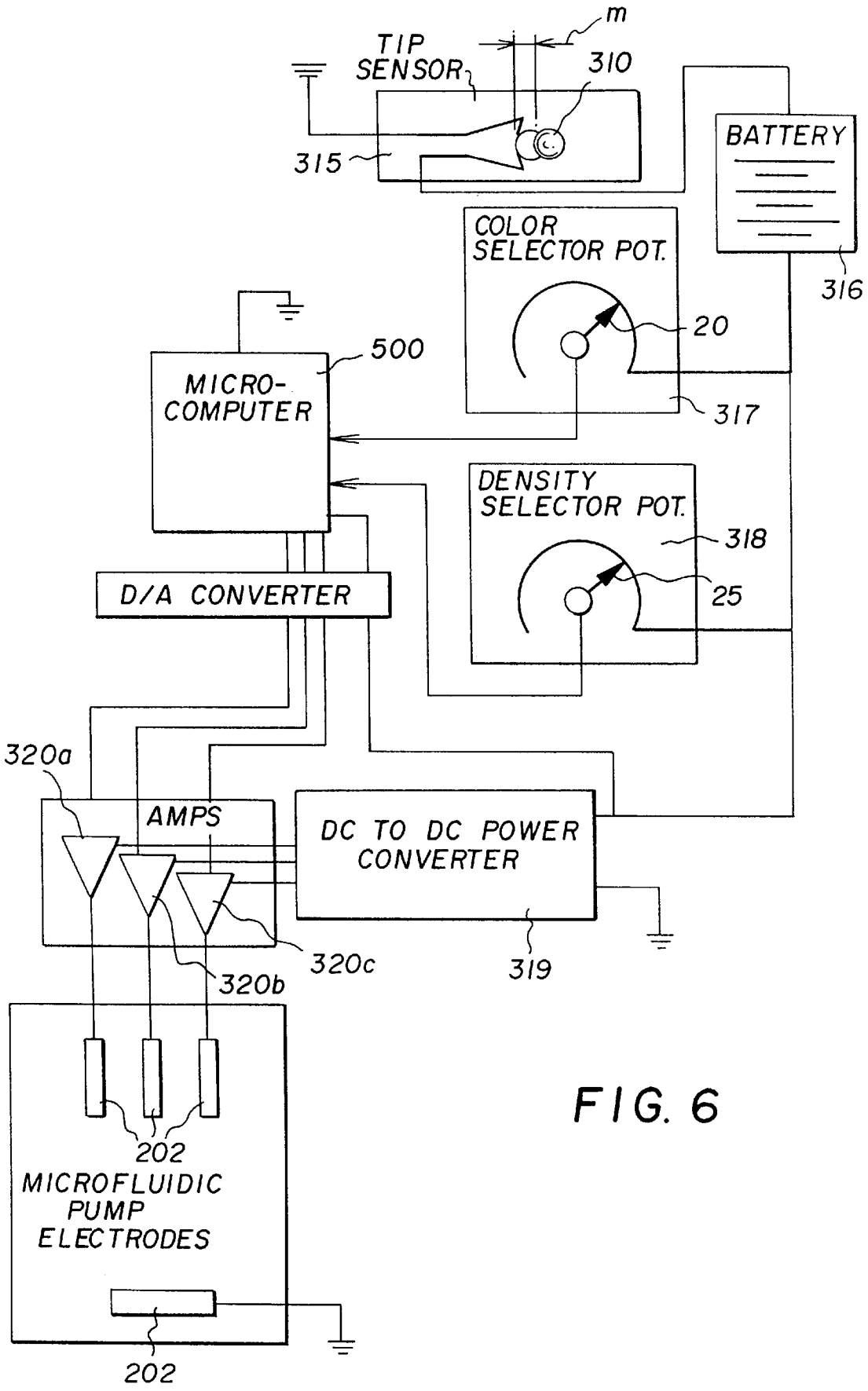
FIG. 6 is a block diagram of the electrial circuitry embodied in the pens of FIGS. 1 and 4.

Turning now to FIG. 6 which shows the electrical circuitry which can be used to operate the different embodiments of the pen 10 shown in FIGS. 1 and 2. When the tip 310 activates or closes the microswitch 315, the microswitch 315 couples the circuitry to a battery 316. The battery 316 is coupled to a potentiometer 317 which is controlled by the color selection knob 20. When the pen 10 of FIG. 2 is used, the battery 316 is also connected to a potentiometer 318 which is controlled by the line width adjusting knob 25. Signals from the potentiometers 317 and 318 are applied to the micro-computer 500. The micro-computer 500 will be understood to include analog to digital circuits which convert the analog signals from the potentiometers 317 and 318 respectively into digital signals. The micro-computer 500 provides signals to power amplifiers 320*a*, 320*b*, and 320*c*. These power amplifiers 320*a*, 320*b* and 320*c* apply the appropriate signal levels to the microkinetic electrodes 202. A DC to DC power amplifier 319 also connected to the battery 316 provides the appropriate voltage levels for controlling the power amplifiers 320*a*, 320*b*, and 320*c*.

In operation, when the FIG. 1 pen 10 arrangement is used, the knob 20 selects the appropriate colors. After the tip 310 closes the microswitch 315, the microcomputer 500 produces digital signals which are converted to analog signals by the power amplifiers 320*a*, 320*b*, and 320*c*. The appropriate amount of colorant from the color supply reservoirs 100, 101, and 102 are now delivered to the mixing chamber 201 and onto the receiver 300 through the channel 311. When the line is completed the user lifts the pen 10 and the channel 311 and the microswtich 315 is opened under the control of the tip 310. The operation of the pen 10 shown in FIG. 2 is the same as with FIG. 1 except that the line width is also computed. The line width is controlled by the micro-computer 500 by adjusting the amount of colorant that will be delivered through the channel 311 to the tip 310.

The invention has been described in detail with particular reference to certain preferred embodiments thereof, but it will be understood that variations and modifications can be effected within the spirit and scope of the invention.

PARTS LIST

| | |
|---|---|
| pen | 10 |
| rotating color selection knob | 20 |
| color selection chart | 21 |
| pointer color select | 22 |
| line width adjusting knob | 25 |
| pointer line width | 26 |
| line width chart | 27 |
| color supply reservoir | 100 |
| color supply reservoir | 101 |
| color supply reservoir | 102 |
| micro-channels | 200 |
| mixing chamber | 201 |
| receiver surface | 300 |
| rotating ball tip | 310 |
| outflow channel | 311 |
| micro computer | 500 |
| battery | 316 |
| color potentiometer | 317 |
| line width potentiometer | 318 |
| power amplifiers | 320a, b, and c |
| micro computer | 500 |

What is claimed is:

1. A microfluidic pen for selectivly writing lines of different colors, comprising:

a) means defining a colorant mixing chamber and a writing tip in communication with the colorant mixing chamber;

b) a plurality of colorant reservoirs disposed in the pen and which contain different colorants;

c) pumping means selectively effective to deliver colorant in selected amounts from the colorant reservoirs to the colorant mixing chamber wherein the colorants are mixed to provide a colorant of the desired color;

d) color selector means responsive to a user selecting the desired line colors and for actuating the pumping means so as to cause the desired amount of colorants to be delivered to the colorant mixing chamber where the writing tip can write a line of the desired line colors.

2. The microfluidic pen of claim 1 further including circuit means having a source of voltage and an electrical circuit actuated by the pen engaging a writing surface for connecting the voltage source to the selected pumps in accordance with the color selected by the selector means for causing a desired amount of colorants to be delivered to the mixing chamber.

3. The microfluidic pen of claim 2 wherein the pumping means includes at least one electrode disposed in operative relationship to each reservoir and responsive to voltage signals provided by the circuit means.

4. The microfluidic pen of claim 2 wherein the writing tip is moveable from an inactive position to an active position when it engages a writing surface and activates the circuit means.

* * * * *